United States Patent [19]

Nation

[11] Patent Number: 4,465,905

[45] Date of Patent: Aug. 14, 1984

[54] LOUDSPEAKER ASSEMBLY

[75] Inventor: Melvin S. Nation, Lombard, Ill.

[73] Assignee: International Jensen Incorporated, Schiller Park, Ill.

[21] Appl. No.: 372,744

[22] Filed: Apr. 28, 1982

[51] Int. Cl.[3] ..... H04R 9/06; H04R 9/04

[52] U.S. Cl. ..... 179/115.5 PC; 179/115.5 R; 179/115.5 VC; 179/119 R

[58] Field of Search ..... 179/115.5 PC, 115.5 VC, 179/115.5 R, 120, 119 R, 117

[56] References Cited

U.S. PATENT DOCUMENTS

| | | | |
|---|---|---|---|
| D. 253,108 | 10/1979 | Schroeder . | |
| 2,566,604 | 9/1951 | Eaves | 179/115.5 R |
| 2,568,621 | 1/1951 | Hopkins et al. . | |
| 3,014,996 | 12/1961 | Swanson | 179/115.5 VC |
| 3,032,615 | 5/1962 | Hanson | 179/115.5 VC |
| 3,118,972 | 1/1964 | Walczak . | |
| 3,176,086 | 3/1965 | Coen . | |
| 3,340,604 | 9/1967 | Parain . | |
| 3,779,337 | 12/1973 | Gregory . | |
| 3,983,337 | 9/1976 | Babb . | |
| 4,068,103 | 1/1978 | King et al. . | |
| 4,122,315 | 10/1978 | Schroeder et al. | 179/115.5 PS |
| 4,144,416 | 3/1979 | Babb . | |
| 4,158,756 | 6/1979 | Keezer . | |

FOREIGN PATENT DOCUMENTS

| | | | |
|---|---|---|---|
| 1901976 | 1/1970 | Fed. Rep. of Germany . | |
| 2133490 | 12/1972 | France . | |
| 55-46674 | 4/1980 | Japan | 179/115.5 PS |
| 55-127797 | 10/1980 | Japan . | |
| 1099425 | 1/1968 | United Kingdom . | |
| 1123082 | 8/1968 | United Kingdom | 179/115.5 PC |
| 1530286 | 10/1978 | United Kingdom . | |
| 310421 | 8/1973 | U.S.S.R. | 179/115.5 R |

*Primary Examiner*—A. D. Pellinen
*Assistant Examiner*—Danita R. Byrd
*Attorney, Agent, or Firm*—Willian, Brinks, Olds, Hofer, Gilson & Lione Ltd.

[57] ABSTRACT

A loudspeaker allowing snap-together assembly and extensive use of plastic is provided. The magnet is substantially enclosed between a molded plastic basket and a first lock member. Deformable fins aid in centering the magnet and in maintaining an annular gap between elements of the magnet. The base of the cone of the loudspeaker is frictionally held between the basket and a second lock member. The electrical connection between the voice coil and the input terminals includes conductive strips formed of conductive ink upon a centering disc. The conductive strips are soldered to the leads of the voice coil and are joined to the input terminals by pressure contacts of a terminal module added at final assembly. A bridge subassembly for mounting within the basket of the loudspeaker is provided to permit snap-together assembly of multiple loadspeaker systems. The electrical connections between the loudspeakers of the multiple loudspeaker system are made at final assembly by the terminal module.

20 Claims, 21 Drawing Figures

FIG. 4
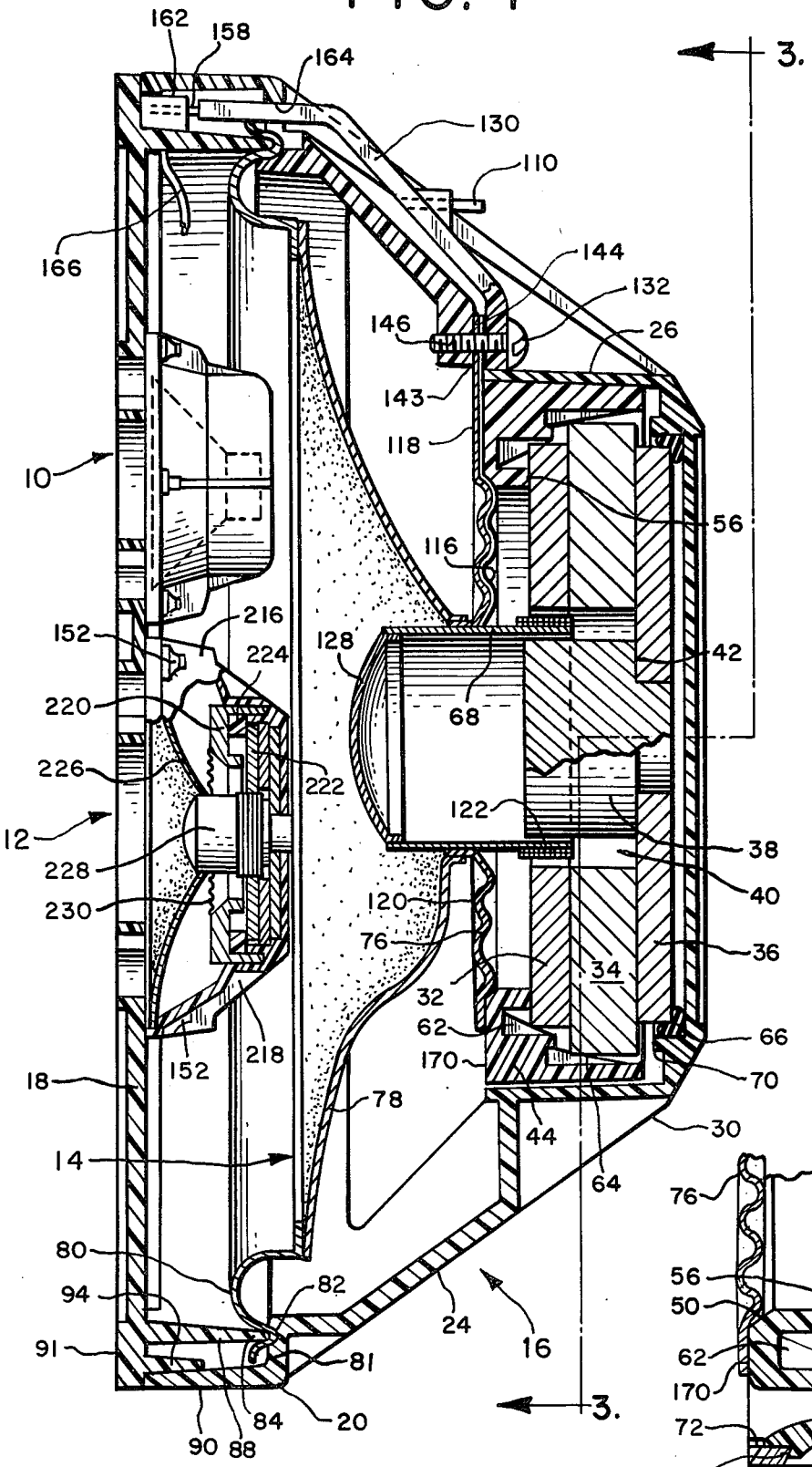
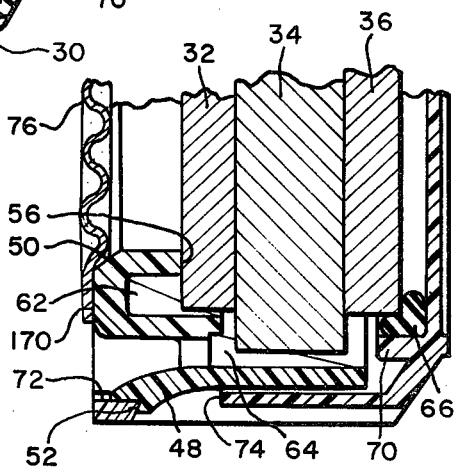
FIG. 7

FIG. 18
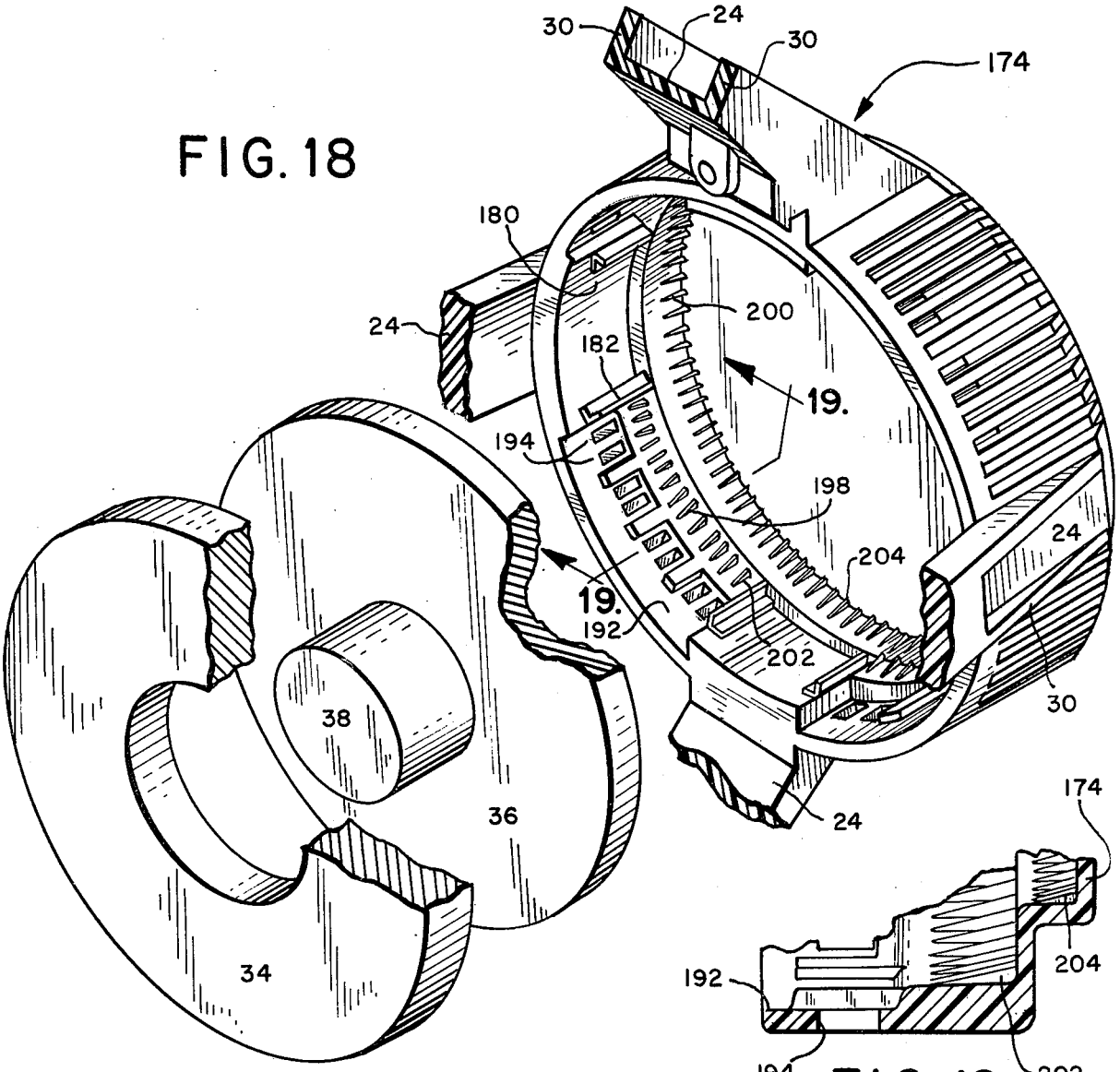
FIG. 19
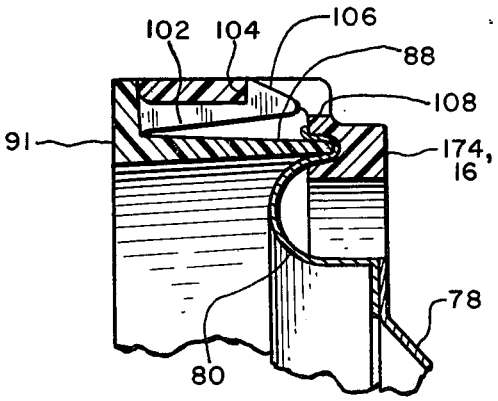
FIG. 20
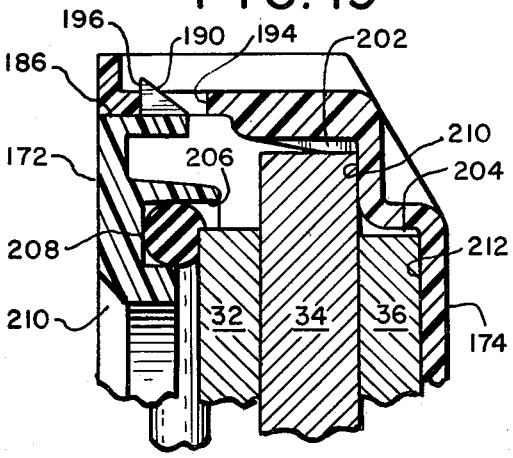
FIG. 21

LOUDSPEAKER ASSEMBLY

BACKGROUND OF THE INVENTION

The present invention relates to a novel loudspeaker construction and method of assembly therefor.

Typically, loudspeakers include a conical diaphragm or cone, formed of paper or other material, which is caused to vibrate by movement of a voice coil located near the apex of the cone. The cone may taper inward from a circular, elliptical, or polygonal base in a variety of configurations. Generally, the voice coil is wound on a thin cylindrical tube which moves within an annular gap of a magnet and is rigidly fixed to the cone. Such conventional loudspeakers may utilize a magnet assembly comprising several elements which are precisely aligned to provide an annular gap having a high gap flux. For example, the magnet assembly may include a ceramic magnetizable field member in the form of an annular ring, front and rear pole plates, and a cylindrical pole piece spaced within the front pole plate and field member so as to form the annular gap. For convenience, the term "magnet" will be used to refer to the entire magnet assembly in this specification.

Several constructions and methods have been devised for maintaining alignment of the elements of the magnet and for securing them to the loudspeaker chassis. The elements of the magnet may be mounted within a metal pot which is staked to a steel basket comprising the loudspeaker chassis during assembly. Although such construction provides some assurance that the annular gap is maintained, the elaborate configuration of the metal pot is expensive and illsuited to modern flat magnets. Another construction utilizes staking to secure a front pole plate to a steel loudspeaker basket while a rear pole plate and a field ring are cemented to the front pole plate by adhesive. Such construction facilitates fixing of the elements of the magnet to maintain the annular gap but, generally, results in distortion and weakening of the gap flux. Further, even with the use of modern adhesives, the elements of the magnet must be held in position for up to five hours while the adhesive cures, adding significantly to the manufacturing cost.

It has been suggested that a front pole plate may be secured to a molded plastic basket by encapsulating the edges of the front pole plate within a portion of the plastic basket. The remaining elements of the magnet may then be fixed to the front pole plate by adhesives in the manner previously described. This use of a molded plastic basket in place of a steel basket will reduce leakage of flux from the magnetic field within the annular gap and will result in a more uniform and higher level of gap flux. However, such suggested construction does not eliminate the manufacturing process in which the elements of the magnet are held in position while an adhesive cures. Further, such suggested construction leaves the field ring of the magnet visible and vulnerable to chipping and other damage, as only the front pole plate is encapsulated by the plastic basket.

It is therefore an object of the present invention to provide an improved loudspeaker assembly in which the basket of the loudspeaker does not reduce the magnetic flux within the annular gap and in which the elements of the magnet are not visible and are protected from chipping and other damage.

It is another object of the present invention to provide an improved method for securing the elements of a magnet of a loudspeaker to the basket of the loudspeaker such that material cost, manufacturing cost, and time of assembly are reduced while maintaining acoustical performance.

In conventional loudspeaker construction, the ends of the voice coil wire are electrically connected to flexible leads, generally formed of braided copper, which extend radially outward along the inside of the cone and are led through the cone to terminals supported from the loudspeaker basket to which the flexible leads are soldered. This manner of assembly is time consuming and requires considerable care and skill. Also, the flexible leads may interfere with the movement of the cone and may generate spurious sounds. Further, the flexible leads are subject to fatigue failure, particularly if solder penetrates the flexible leads and stiffens a portion of the flexible leads, a problem known as "wicking up" of the lead wires. Due to the frequency and amplitude of the vibration of the voice coil and cone relative to the basket of the loudspeaker to which the flexible leads are connected, breakage of the flexible leads is a major cause of loudspeaker failure.

It has been suggested that the flexible leads connected to the voice coil wires could be replaced by conductive strips painted upon or woven into a nonconductive centering disc or spider. However, the use of conductive strips upon a nonconductive centering disc or spider of a loudspeaker has been largely unsuccessful, in part because the known technology results in unacceptable resistance of the conductive strips and inability of the conductive strips to withstand repeated flexure or vibration. Other unsolved problems have been the high manufacturing cost of forming the conductive strips and difficulties related to establishing electrical connections between the conductive strips, the voice coil wires, and the terminals supported from the loudspeaker basket.

It is therefore a further object of the present invention to provide an improved electrical connection between the voice coil wires and the basket terminals of a loudspeaker by means of conductive strips having low resistance and the ability to withstand repeated flexure and vibration without impairment.

It is a further object of the present invention to provide an improved method of connecting the voice coil wires of a loudspeaker to a conductive strip formed upon a nonconductive centering disc or spider, resulting in ease of manufacture, reduced manufacturing cost, and positive electrical continuity.

It is a further object of the present invention to provide an improved method of connecting the terminals supported from the basket of a loudspeaker to a conductive strip formed upon a centering disc or spider of a loudspeaker resulting in ease of assembly, reduced manufacturing cost, and positive electrical continuity.

Particularly in loudspeakers designed for low frequency sound reproduction, conventional speakers may include a flexible member along the perimeter of the cone to facilitate axial displacement of the cone relative to the basket of the loudspeaker. Typically, this flexible member comprises a surround molded of a rubber or synthetic material which may be a thin layer of foam. The surround is generally cemented along its internal perimeter to the cone and along its external perimeter to the basket of the loudspeaker. A pad ring is often cemented to the front of the basket of the loudspeaker to provide clearance for the surround and to facilitate mounting of supplementary loudspeakers. The cementing of the pad ring and the surround to the basket of the loudspeaker tends to avoid undesired resonances, but the operation is time consuming and expensive and requires considerable care and skill.

It is therefore a further object of the present invention to provide an improved method of mounting the surround and the pad ring of a loudspeaker upon the basket of a loudspeaker resulting in ease of assembly, reduced assembly time, and decreased manufacturing cost.

One or more smaller loudspeakers may be mounted within the cone of a larger loudspeaker. Typically, a bridge, formed as a metal stamping, is screwed to the front of the pad ring to provide a mounting for one or more smaller loudspeakers. In a three-way loudspeaker system, for example, a tweeter and midrange may be mounted upon a bridge which is mounted upon the woofer of a loudspeaker system. However, the assembly of such a loudspeaker system is generally difficult and tedious because of the large number of separate parts involved and the practice of threading the flexible electrical leads from the tweeter and midrange through the cone of the woofer to the terminals supported from the basket of the loudspeaker. Further, the interaction of the flexible leads with the cone of the woofer may generate spurious sounds, and the separate parts may produce undesired "ringing" and resonances.

It is therefore a further object of the present invention to provide an improved method of electrically connecting one or more loudspeakers mounted within the cone of a larger loudspeaker to the terminals supported from the basket of the larger loudspeaker.

It is a further object of the present invention to provide an improved method of assembling a loudspeaker system having at least one smaller loudspeaker mounted within a larger loudspeaker such that a series of subassemblies can be easily joined together and such that all necessary soldering of electrical connections is completed before final assembly.

It is still a further object of the present invention to provide an improved loudspeaker system having at least one smaller loudspeaker mounted within a larger loudspeaker such that the number of separate parts is substantially reduced and in which adhesive is substantially eliminated.

SUMMARY OF THE INVENTION

The present invention is directed to an improved loudspeaker construction as well as to the method of assembly therefor.

According to one aspect of this invention, an improved loudspeaker is provided which includes means for providing a recess within the basket so as to partially enclose the magnet of the loudspeaker. A lock member in mechanical engagement with the basket further encloses the magnet and locks the magnet in place. As illustrated by the preferred embodiments, the basket may be molded of plastic, and locking fingers or other detent means may be employed to provide the locking engagement between the lock member and the basket. Biasing means between the lock member and the basket may be provided to ensure constant loading on the magnet to hold the magnet in position. Either the basket or the lock member may include a plurality of fins which are deformed about one or more elements of the magnet during assembly to facilitate centering of the magnet and to prevent shifting of the elements of the magnet after assembly. An advantage of this construction is the elimination of reduction or distortion of the magnetic flux within the annular gap. Further, the magnet is not visible and is protected from chipping or other damage, and the lengthy manufacturing operation of curing an adhesive is eliminated.

According to a second aspect of this invention, an improved method of mounting the diaphragm or cone of a loudspeaker is provided. A lock member in engagement with the basket captures the perimeter of the diaphragm to fix the diaphragm to the basket. Preferably, the capture of the perimeter of the diaphragm by the lock member includes a tongue and a complementary groove abutting opposite sides of the diaphragm to maintain the diaphragm in fixed relationship to the basket. Locking fingers or other detent means may be provided between the lock member and the basket to lock the lock member in place. This construction simplifies the assembly of the loudspeaker by eliminating the cementing of the diaphragm to the loudspeaker basket as well as the cementing of the pad ring to the loudspeaker basket. Because the basket and the lock member incorporate the functions of a conventional pad ring, a separate pad ring is not required.

According to a third aspect of this invention, improved electrical connections between the voice coil of a loudspeaker and the input terminals are provided. The electrical connections include at least two conductive strips upon a centering disc. The conductive strips are formed by heat forming a resin impregnated blank to which a conductive ink has been applied. The lead wire of the voice coil is soldered to the conductive strips by raising the solder to a predetermined temperature range. Preferably, the conductive ink is a polymer containing silver particles. The conductive strips may be electrically connected to the input terminals by a terminal module having metallic strips which make a pressure contact with the conductive strips. This construction eliminates a major cause of loudspeaker failure and greatly simplifies the assembly of the loudspeaker. In addition, sound quality is enhanced due to the elimination of separate lead wires passed through the cone of the loudspeaker.

An improved multiple loudspeaker system having one or more smaller speakers mounted within the basket of a larger speaker is also provided according to this invention. A bridge member engages the basket of the larger loudspeaker by detent means to permit snap-together final assembly. The smaller loudspeaker is mounted to the bridge member and is connected to bridge terminals which are accessible after final assembly of the bridge member to the basket of the larger loudspeaker. Preferably, a terminal module as previously described is used to connect the smaller loudspeaker to the larger loudspeaker and to connect the smaller loudspeaker to the input terminals. This construction eliminates the separate lead wires of the smaller loudspeaker which are passed through the cone of the larger loudspeaker in conventional loudspeaker systems. As a result, final assembly of the loudspeaker system is greatly simplified, and spurious sounds caused by the interaction of the lead wires and the cone are eliminated.

The invention, together with further objects and attendant advantages, will be best understood by reference to the following detailed description of the preferred embodiments taken in conjunction with the accompanying drawings.

BRIEF DESCRIPTION OF THE DRAWINGS

FIG. 4 is a sectional view of the first preferred embodiment of the present invention from the right side, taken along the line 4—4 of FIG. 1;

FIG. 7 is an enlarged sectional view of portions of the first preferred embodiment of the present invention taken along the line 7—7 of FIG. 3;

FIG. 18 is an exploded view of portions of the second preferred embodiment of the present invention showing elements of the magnet in relation to the basket;

FIG. 19 is an enlarged sectional view of portions of the basket of the second preferred embodiment of the present invention taken along the line 19—19 of FIG. 18;

FIG. 20 is an enlarged sectional view of portions of either the first or the second preferred embodiment of the present invention taken along the line 20—20 of FIG. 3 or the line 20—20 of FIG. 14; and FIG. 21 is an enlarged sectional view of portions of the second preferred embodiment of the present invention taken along the line 21—21 of FIG. 14.

DESCRIPTION OF THE PREFERRED EMBODIMENTS

Figure 2:
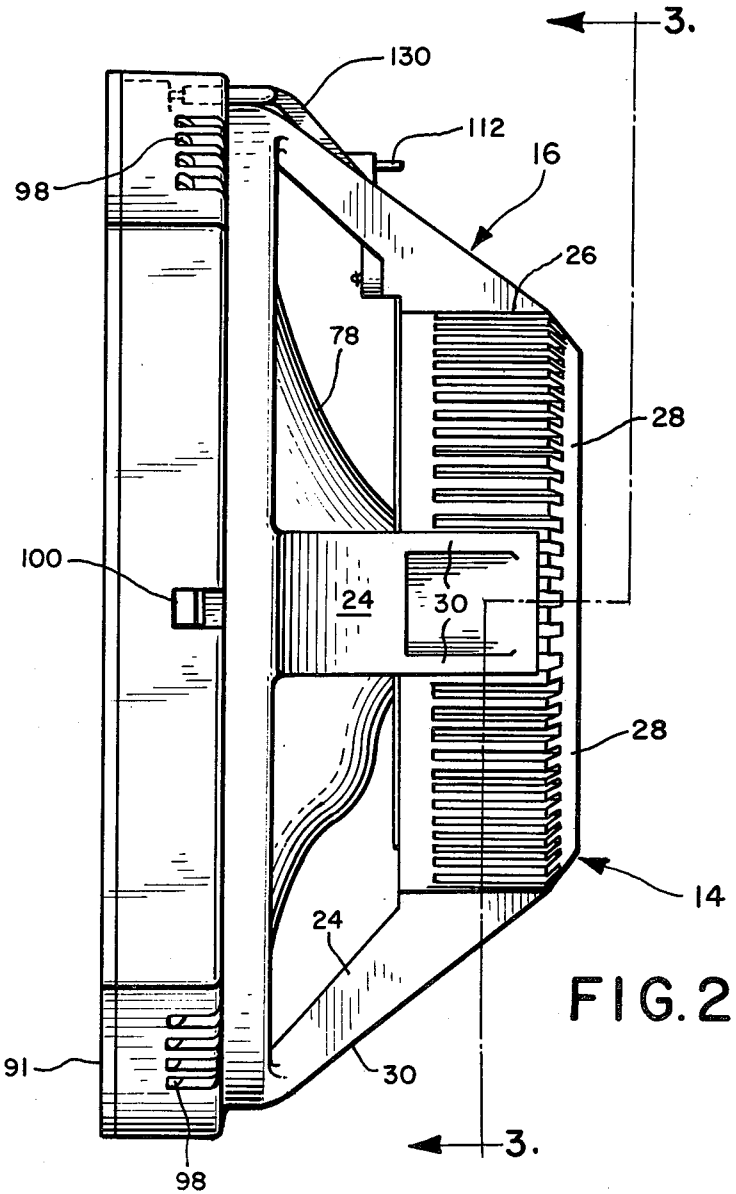
FIG. 2 is a right side elevation of the first preferred embodiment of the present invention.
Figure 1:
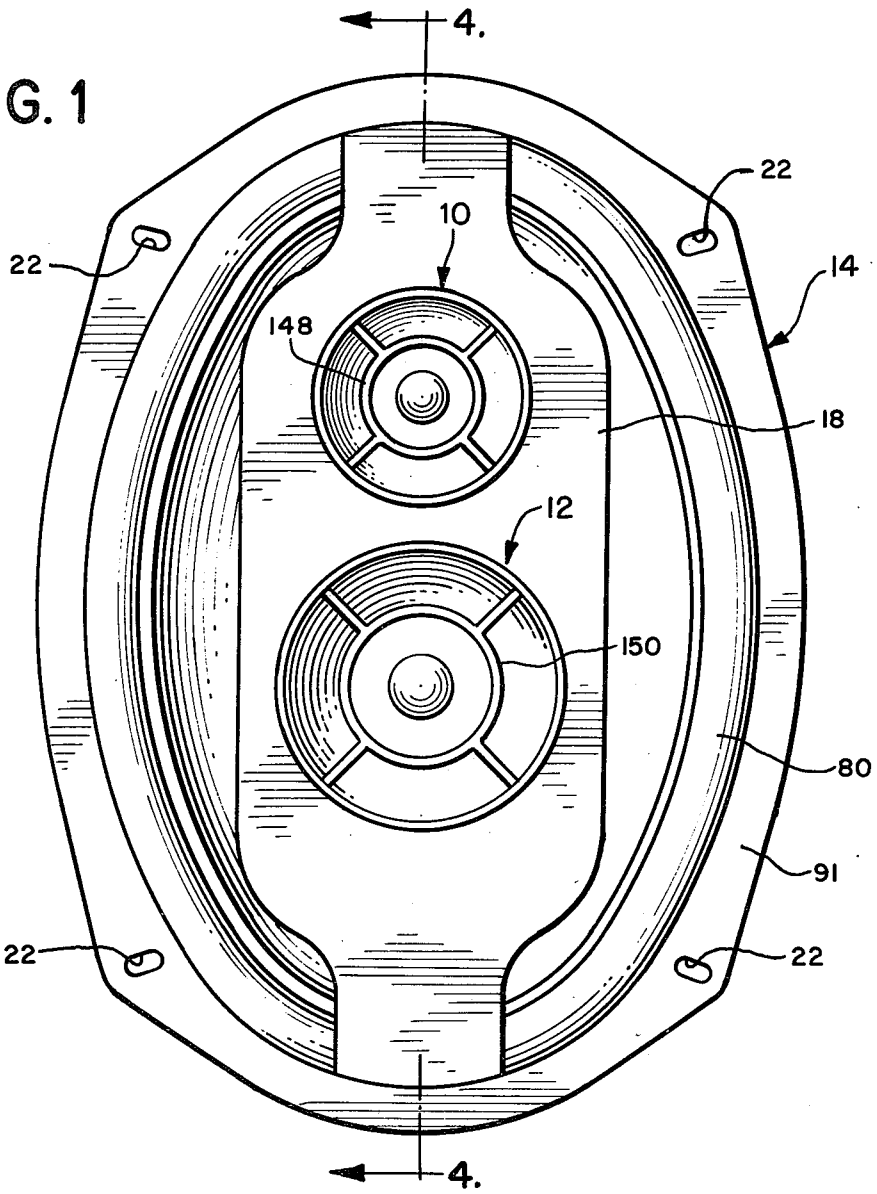
FIG. 1 is a front elevation of a first preferred embodiment of the present invention comprising a three-way loudspeaker system.

With reference to the drawings, a first preferred embodiment of a 3-way loudspeaker system made in accordance with the present invention is shown in FIGS. 1 through 13 and 20. The loudspeaker system comprises a tweeter, midrange, and woofer, indicated generally by the numerals 10, 12, and 14, respectively, as shown in FIGS. 1 and 2. The woofer 14 includes a molded basket, indicated generally by the numeral 16, which serves as a chassis for the loudspeaker system. The tweeter 10 and the midrange 12 are mounted within the woofer 14 upon a bridge 18.

Figure 3:
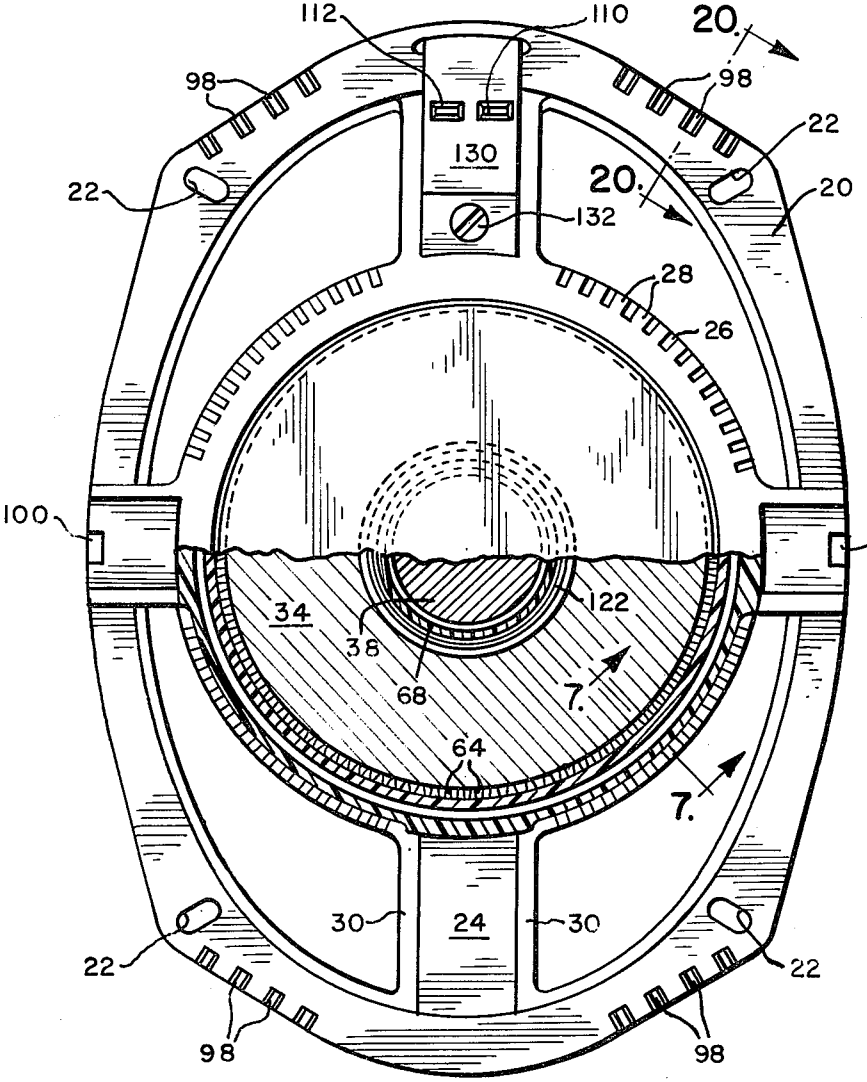
FIG. 3 is a rear view of the first preferred embodiment of the present invention, partially in section as indicated by the line 3—3 of FIG. 2.

The molded basket 16 of the woofer 14 includes a generally elliptical forward flange 20 which includes four mounting slots 22 spaced along the perimeter as shown in FIG. 3. Four angled legs 24 connect the forward flange 20 to a rearward cylindrical portion 26 which serves as a housing for the magnet of the woofer 14. The legs 24 have substantially radial ribs 30 to provide increased rigidity of the cylindrical portion 26. The surface of the cylindrical portion 26 of the molded basket 16 may be substantially smooth or may include surface details, for example, regularly spaced longitudinal ribs 28 as shown. The preferred material of the molded basket 16 is Noryl N300 as supplied by General Electric Company of Fairfield, Conn. However, other tough resilient plastics such as ABS may be used.

The magnet of the woofer 14, which is housed within the cylindrical portion 26 of the molded basket 16, includes a front pole plate 32, a ceramic magnetizable annular ring 34, and a rear pole plate 36, as shown in FIG. 4. A cylindrical pole piece 38 is fixed to the rear pole plate 36 so as to provide an annular gap 40 between the cylindrical pole piece 38 and the front pole plate 32 and the annular ring 34. The cylindrical pole piece 38 may include a shoulder 42 formed by reducing the diameter along the rearward circumference of the cylindrical pole piece 38, as shown, and may be fixed to the rear pole plate 36 by staking, by swaging, or by a pressed fit.

Figure 5:
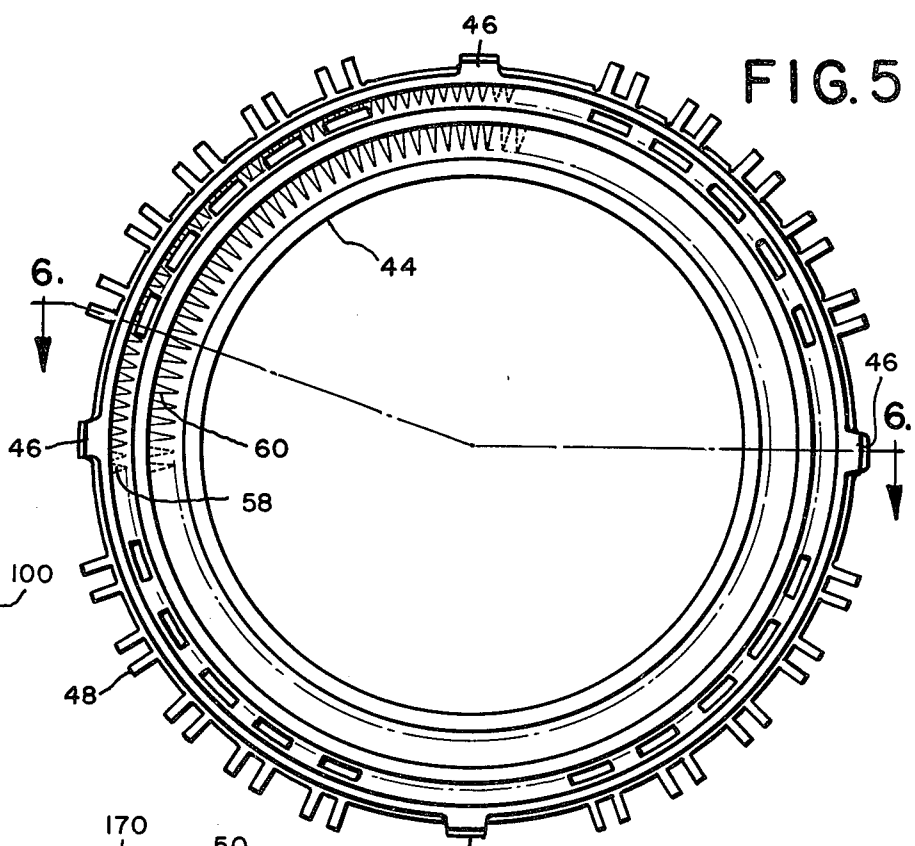
FIG. 5 is a rear view of the snap ring of the first preferred embodiment of the present invention.
Figure 6:
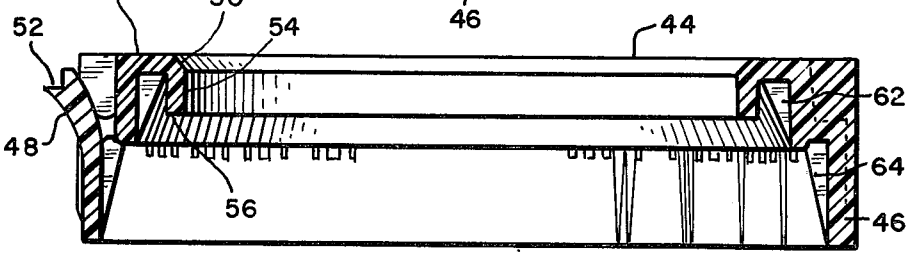
FIG. 6 is a sectional view of the snap ring of the first preferred embodiment of the present invention taken along the line 6—6 of FIG. 5.

The mounting of the elements of the magnet within the cylindrical portion 26 of the basket is accomplished by means of a snap ring 44 which is shown in FIGS. 5 and 6. The snap ring 44 includes four equally spaced alignment ribs 46 for engagement of corresponding channels in the molded basket 16. The snap ring 44 also includes regularly spaced pairs of resilient locking fingers 48 which are curved outward radially so as to engage the molded basket 16. The forward facing edge of the inside diameter of the snap ring 44 is beveled to form a chamfer 50 to provide clearance for the spider of the woofer 14, described below. The locking fingers 48 include notches or steps 52 which are aligned so as to provide substantially radial and longitudinal surfaces for providing positive location of the snap ring 44 with respect to the molded basket 16. The preferred material of the snap ring 44 is Noryl N300; however, other tough, resilient plastics such as ABS may be used.

The inside portion of the snap ring 44 includes a longitudinally extending annular flange 54 which terminates in a flat annular surface 56 for abutment with the front pole plate 32. The interior of the snap ring 44 also includes two annular rows 58 and 60 of deformable fins 62 and 64, respectively, which facilitate the alignment of the front pole plate 32 and the annular ring 34. Specifically, the fins 62 and 64 assist in centering the elements of the magnet within the cylindrical portion 26 of the molded basket 16 during assembly. The fins 62 and 64 provide an interference fit with the respective elements of the magnet. The crushing of the fins 62 and 64 about the front pole plate 32 and the annular ring 34 during assembly ensures that the elements of the magnet will not subsequently shift with respect to the molded basket 16, regardless of manufacturing variations in the diameter of the front pole plate 32 and annular ring 34.

The rear pole plate 36 is held in position against the annular ring 34 by a neoprene O-ring 66 which is positioned against an internal flange 68 of the cylindrical portion 26 of the molded basket 16. The O-ring 66 is compressed during assembly so as to contact and exert a constant loading force upon both the flat rearward portion of the rear pole plate 36 and the cylindrical side portion thereof. In this way, the O-ring 66 forces the front pole plate 32 against the flat annular surface 56 of the snap ring 44 to provide positive front to rear location of the front pole plate 32 relative to the molded basket. Similarly, the O-ring 66 forces the front pole plate 32 and the annular ring 34 into the fins 62 and 64, respectively, so as to cause crushing of the fins 62 and 64 during assembly of the woofer 14.

FIG. 7 shows the engagement of the basket 16 by the locking fingers 48. During assembly, the locking fingers 48 are bent inward as the outwardly curved portions thereof are forced past a cylindrical surface 72 of the basket 16. When the locking fingers 48 reach corresponding openings 74 in the cylindrical surface 72, the resilient locking fingers spring outward into the position shown in FIG. 7. The substantially longitudinal surfaces of the steps 52 thereupon engage the cylindrical surface 72, and the substantially radial surfaces of the step 52 engage the forward edges of the openings 74, thereby providing positive location of the snap ring relative to the molded basket 16. In practice, this assembly procedure is completed while a removable alignment fixture is inserted in the annular gap 40 between the cylindrical pole piece 38 and the front pole plate 32 and the annular ring 34 of the magnet. In this way, the fins 62 and 64 are crushed so as to form a tightly fitting pocket for maintaining the annular gap 40 after the alignment fixture is removed.

A cylindrical voice coil 68, movable axially within the annular gap 40, is supported by a nonconductive centering disc or spider 76 which is cemented or otherwise secured to the snap ring 44, as shown in FIG. 4. The spider 76 may be formed of stiffened fabric as described below and may include annular corrugations to facilitate axial movement of the voice coil relative to the front pole plate 32 and the annular ring 34. The chamfer 50 of the snap ring 44 provides clearance for the corrugations of the spider 76 to permit the voice coil 68 to move axially within the annular gap 40.

The voice coil 68 provides movement of an elliptical cone 78 which is cemented to the voice coil 68 about the apex, as shown in FIG. 4. The perimeter of the cone 78 is cemented to a foam surround 80 which includes a 180 degree curl presenting a convex surface toward the front of the loudspeaker. The periphery of the foam surround 80 is formed in a flat plane perpendicular to the axis of the magnet. The flat periphery of the foam surround 80 overlies a forwardly facing flange 81 of the molded basket 16.

Figure 8:
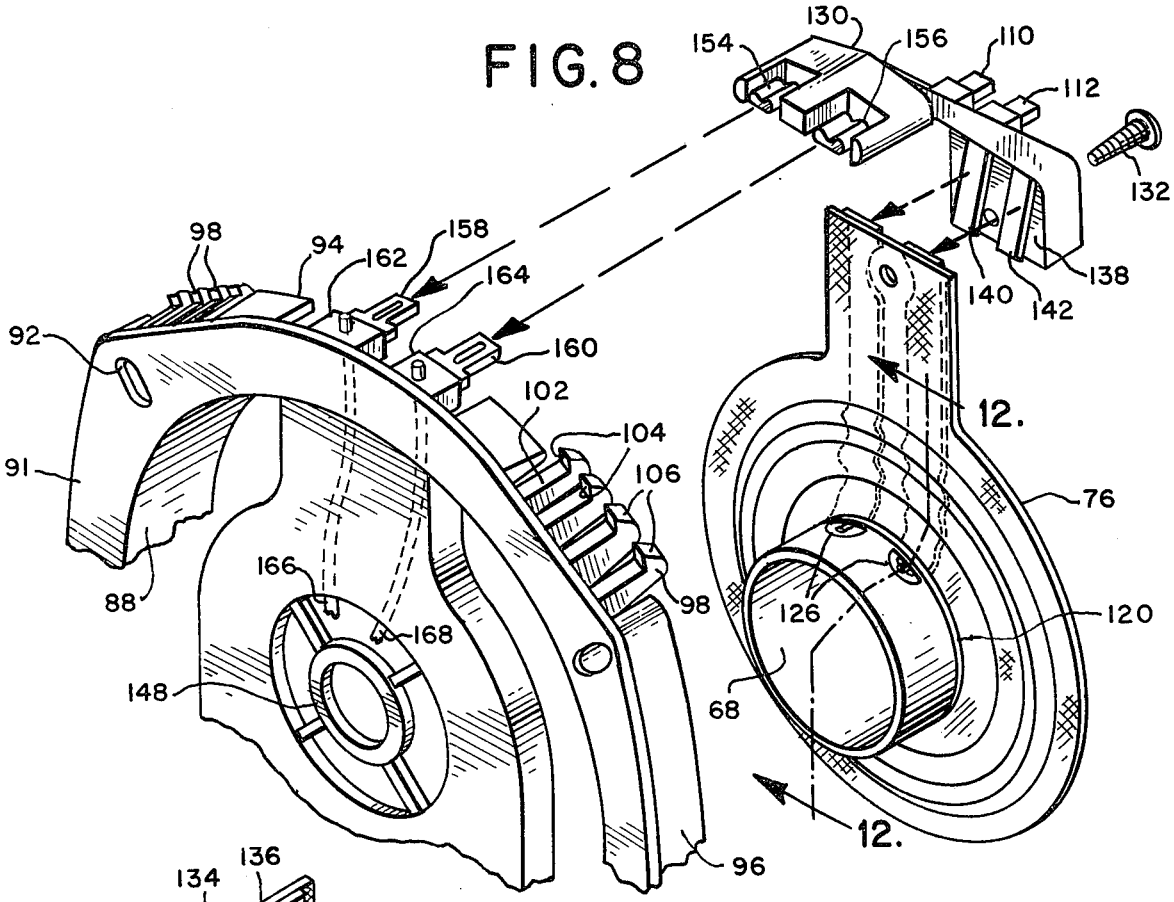
FIG. 8 is an exploded view of portions of the first preferred embodiment of the present invention showing the electrical connections.

The flange 81 of the molded basket 16 includes a groove 82 for receiving a tongue 84, as shown in FIG. 4. The tongue 84 is a rearward extension of an elliptical ring 88 which fits within a sidewall portion 90 of the forward flange 20 of the molded basket 16. The elliptical ring 88 is formed integrally with a face plate 91 which overlies the sidewall portion 90 of the molded basket 16 and which includes mounting slots 92 in alignment with the mounting slots 22 of the molded basket 16. As shown in FIGS. 4 and 8, end locating flanges 94 and side locating flanges 96 project rearward from the face plate 91 corresponding to the inside surfaces of the sidewall portion 90 to provide positive location of the elliptical ring 88. The preferred material for the elliptical ring 88 is Noryl N300; however, other tough resilient plastics such as ABS may be used.

The face plate 91 and the elliptical ring 88 are locked in position by resilient locking fingers 98 and 100 which are spaced along the perimeter of the face plate 91 in the spaces between the locating flanges 94 and 96, as shown in FIGS. 3 and 8. The number and placement of the locking fingers 98 and 100 are sufficient to provide a substantially uniform pressure of the tongue 84 against the groove 82 of the molded basket 16. In this way, the foam surround 80, which overlies the groove 82 so as to be captured by engagement of the tongue 84 with the groove 82, is securely held in place without being cut. The number and placement of the locking fingers shown, namely, four locking fingers 98 adjacent each mounting slot 92 and wider locking fingers 100 at the midpoints of the sides of the face plate 91, are merely illustrative.

The locking fingers 98 and 100 are angled slightly outward along stalk portions 102 in relation to the locating flanges 94 and 96 and include flat barb portions 104 which are substantially parallel to the face plate 91. The ends of the locking fingers 98 and 100 have beveled surfaces 106 which angle inward in the rearward direction to facilitate insertion of the elliptical ring 88 into the sidewall portion 90 of the molded basket 16. The beveled surfaces 106 engage substantially flat surfaces of the inside of the sidewall portion 90 so as to bend the locking fingers 98 and 100 inward during assembly. Openings 108 are formed in the sidewall portion 90 of the molded basket 16 corresponding to the location of the flat barb portions 104 and the beveled surfaces 106 so as to permit the locking fingers 98 and 100 to snap outward to the position shown in FIG. 20. Due to the slightly outward extension of the stalk portions 102 of the locking fingers 98 and 100 before assembly, the locking fingers 98 and 100 are biased outward against the inside of the sidewall portion 90 of the molded basket 16 in the assembled position so as to prevent undesired resonances.

Figure 11:
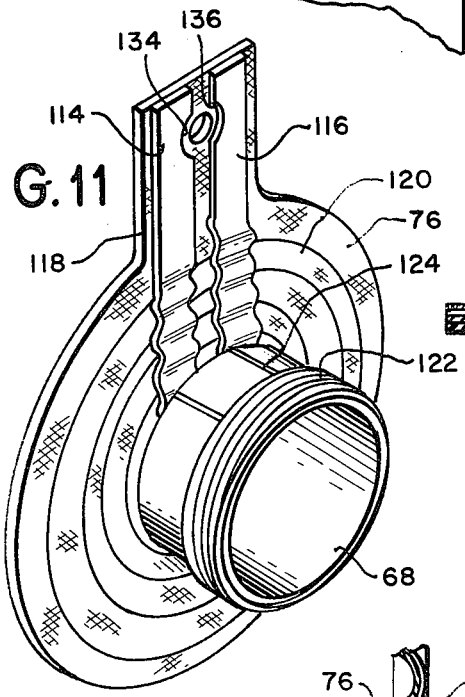
FIG. 11 is a perspective view of the spider and voice coil assembly of the first preferred embodiment of the present invention.
Figure 9:
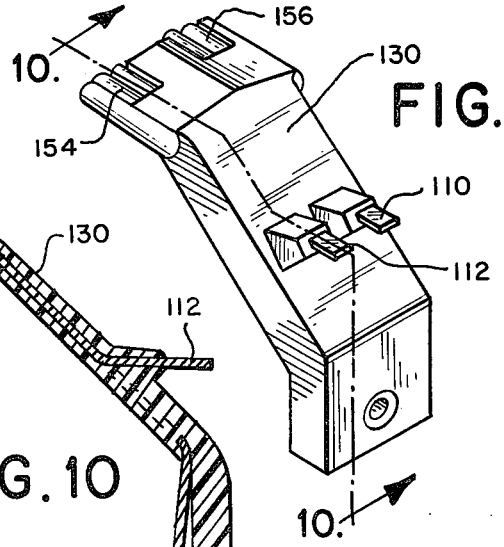
FIG. 9 is a perspective view of the terminal module of the first preferred embodiment of the present invention.

Electrical continuity between the voice coil 68 and two input terminals 110 and 112 is achieved by two conductive strips 114 and 116, respectively, formed upon the spider 76 and upon a radially extending tab 118 formed integrally with the spider 76, as shown in FIG. 11. In forming the conductive strips 114 and the spider 76, a limp cotton cloth is first impregnated with a thermal setting resin, dried, and bolted. The preferred impregnated material is W140 as supplied by Nu-Way Speaker Products, Inc. of Antioch, Ill. Other types of cloth such as muslin or other fibrous material such as a mat made of randomly arranged fibers could, alternatively, be used to form the blank.

This "pre-pregged" cloth blank is then silk screened with a conductive ink to the contour of the desired conductive strips 114 and 116. Applicant has found that conductive compounds C-929-91 and C-210-2 as supplied by Amicon Corporation of Lexington, Mass. are particularly well suited for this use. For the first application, compound C-929-91, a premixed dilute solution containing silver particles, is used to penetrate through the pre-pregged cloth blank and thoroughly coat the fibers thereof. Compound C-210-2, a thicker, pastelike solution having 68 percent silver particles by weight, is silk screened over the first application of conductive ink along the same desired contours of the conductive strips 114 and 116. Applicant has found that this two-step application of the conductive ink locks the conductive strips to the fabric of the spider 76 to prevent cracking or peeling and results in improved conductivity of the conductive strips 114 and 116.

The next step in the formation of the spider 76 and conductive strips 114 and 116 is the thermal forming of the pre-pregged and silk screened blank. The cloth is pressed in a heated fixture to a temperature of 480–500 degrees Fahrenheit at 900 pounds per square inch for 10 seconds so as to form a series of concentric corrugations 119 and a rolled flange or skirt 120 having the conductive strips 114 and 116 along an inside diameter corresponding to the diameter of the voice coil 68. During this thermal forming, the metallic particles of the conductive ink, which are initially substantially spherical balls, are advantageously altered. It is Applicant's belief that the metallic particles are flattened from the substantially spherical balls into pancake like particles aligned substantially with the plane of the blank. These flattened metallic particles are more intimately in contact with each other and with the fibers of the blank.

The altering of the metallic particles overcomes the prior art problems of poor electrical conductivity of the conductive strips 114 and 116 and inadequate bonding of the conductive strips 114 and 116 to the spider 76. In addition, the thermal forming overcomes problems related to soldering. Soldering of more conventional conductive strips has not been possible because of the tendency of the substantially spherical balls of the conductive ink to "run" from the soldering tip once a soldering temperature is reached. Applicant applies sufficient heat and pressure to alter the spherical balls sufficiently to permit soldering. The temperature and pressure ranges required will be dependent upon the particular conductive ink and the material of the blank used, hence the temperature and pressures listed herein are merely illustrative.

The voice coil 68 includes a double layer of insulated windings 122 from which two insulated wire leads 124 extend longitudinally along the outer surface of the voice coil 68. The two leads 124 are spaced apart at a distance corresponding to the spacing of the conductive strips 114 and 116 and overlie a pair of circular holes 126 punched through the voice coil 68. The windings 122 and the two leads 124 may conveniently be cemented to the voice coil 68, and the cylindrical tube of the voice coil 68 may be conveniently formed of a paper or fiber reinforced synthetic material. During assembly, the voice coil 68 is placed in a fixture such that one end of the voice coil 68 protrudes. The spider 76 is then forced over the free end of the voice coil 68 into contact with the fixture such that the windings 122 are spaced a predetermined distance from the spider 76 and away from the skirt 120. A cement is then applied between the spider 76 and the voice coil 68 from the side of the spider 76 corresponding to the end of the voice coil 68 having the windings 122.

An electrical connection is effected between the conductive strips 114 and 116 and the two leads 124 of the voice coil 68 by carefully following a series of steps. First, the assembled spider 76 and the voice coil 68 are inverted from the position shown in FIGS. 8 and 11 to a position in which the holes 126 and the tab 118 are directed downward. The free ends of the two leads 124 are then pulled through the holes 126 and away from the windings 122 in a longitudinal direction and outward so as to force the leads 124 tightly against the conductive strips 114 and 116. The two leads 124 are then carefully soldered to the conductive strips 114 and 116 by using a temperature controlled soldering iron with the tip maintained between 426 and 445 degrees Fahrenheit. Although other solders containing silver may be used, Applicant has found that a satisfactory soldered connection can be conveniently and economically made using standard 60/40 radio-TV solder with a resin core. The two leads 124 are insulated with Strip-Ease enamel which eliminates the need for stripping before soldering. After soldering, the free ends of the two leads 124 are clipped adjacent the skirt 120 of the spider 76 and a dust cover 128 is cemented to the inside of the voice coil 68, as shown in FIG. 4.

Figure 10:
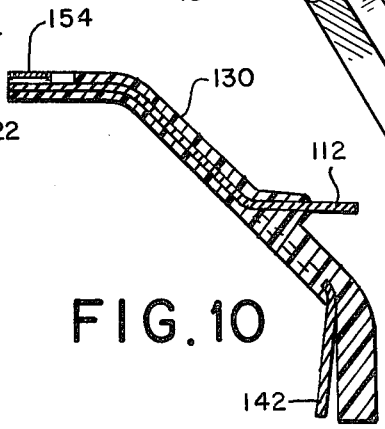
FIG. 10 is a sectional view of the terminal module of the first preferred embodiment taken along the line 10—10 of FIG. 9.
Figure 12:
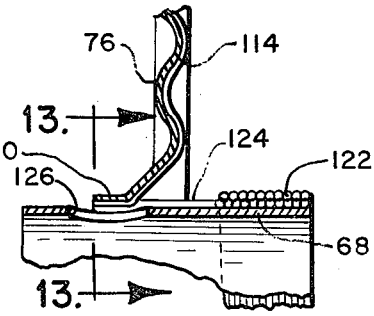
FIG. 12 is an enlarged sectional view of portions of the spider and voice coil assembly of the first preferred embodiment of the present invention taken along the line 12—12 of FIG. 8.
Figure 13:
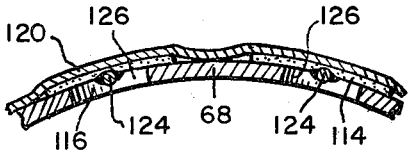
FIG. 13 is an enlarged sectional view of portions of the spider and voice coil assembly of the first preferred embodiment of the present invention taken along the line 13—13 of FIG. 12.

The input terminals 110 and 112 are embedded within a terminal module 130 which is secured to the molded basket 16 from the rear by a screw 132. The conductive strips 114 and 116 include notches 134 and 136 to ensure that the screw 132 does not form a short circuit between the conductive strips 114 and 116. In the preferred embodiments shown, the input terminals 110 and 112 are struck from tin plated strips of brass which are embedded within the terminal module 130. At the rearward end of the terminal module 130, the tin plated brass strips protrude from the terminal module 130 and are angled forward of a flat rearward portion 138 of the terminal module 130 so as to form two spring contacts 140 and 142 as shown in FIGS. 8 and 10. At an intermediate point along the terminal module 130, the tin plated strips of brass protrude as the terminals 110 and 112. The terminal module 130 may be molded of Noryl N300, ABS, or other tough non-conductive plastic.

During assembly of the woofer 14, the tab 118 of the spider 76 is guided through a narrow slot 143 in the molded basket 16 adjacent to the cylindrical portion 26, as shown in FIG. 4. In that position, the tab 118 overlies a flat portion 144 of the molded basket 16 which is perpendicular to the axis of the magnet of the woofer 14. As the screw 132 is threaded into a hole 146 in the flat portion 144, the spring contacts 140 and 142 are biased by their resiliency against the conductive strips 114 and 116, respectively, to ensure that positive electrical contact is made and maintained.

In addition to the woofer 14 which has been described, the first preferred embodiment includes the tweeter 10 and the midrange 12 which are mounted within the woofer 14 upon the bridge 18. As best shown in FIGS. 4 and 8, the bridge 18 may be formed integrally with the face plate 91 and the elliptical ring 88. The bridge 18 may include a tweeter grille 148 and a midrange grille 150 and may also include split mushroom type fixing studs 152 or similar mounting devices for the tweeter 10 and the midrange 12. The tweeter 10 and the midrange 12 may be of conventional design or may be scaled down replicas of the woofer 14 previously described. The midrange 12 shown in FIG. 4 has a construction following the second preferred embodiment described below.

The electrical connection between the tweeter 10 and the midrange 12 with the input terminals 110 and 114 is effected conveniently by the installation of the terminal module 130 previously described. The strips of tin plated brass from which the input terminals 110 and 112 are struck protrude forward from the terminal module 130 parallel to the axis of the magnet of the woofer and are rolled so as to form female connectors 154 and 156. The female connectors engage two complementary tab terminals 158 and 160, respectively, protruding from flanges 162 and 164 which extend rearward from the face plate 91 through a slotted opening 164 within the forwardly facing flange 82 of the molded basket 16. The tab terminals 158 and 160 may be pinch terminals of conventional design or may be terminals of Applicant's own solderless connection design disclosed in a copending application. The wires 166 and 168 are connected to the tweeter 10 and the midrange 12 through a conventional crossover network, not shown.

It will be noted that the final assembly of the 3-way loudspeaker shown in FIGS. 1 through 13 and 20 can be easily effected without the need for solder or adhesive after the various subassemblies are formed. Namely, at the time of final assembly, the tweeter 10, the midrange 12, the crossover netework, not shown, the wires 166 and 168, and the tab terminals 158 and 160 are preassembled to the face plate 91 which is formed integrally with the elliptical ring 88 and the bridge 18. Further, at the time of final assembly, the foam surround 80, the cone 78, the spider 76, the conductive strips 114 and 116, the dust cover 128, and the voice coil 68 are preassembled to form a subassembly.

During final assembly, the speaker basket 16 is oriented such that the cylindrical portion 126 is downward and the flange 82 of the molded basket 16 is directed upward. In this orientation, the O-ring 66 is laid in position as shown in FIG. 4, and the elements of the magnet of the woofer 14 are laid over the O-ring 66 and are locked in place by the snap ring 44 as previously described. The tab 118 of the spider 76 is then inserted through the slot 143 of the molded basket 16, and the annular perimeter of the spider 76 is cemented to the normally forward flat surface 170 of the snap ring 44. the subassembly including the face plate 91 is then snapped into the assembled position shown in FIG. 20 so as to capture and secure the perimeter of the foam surround 80. The female connectors 154 and 156 of the terminal module 130 are then forced over the tab terminals 158 and 160, and the screw 132 is inserted through the terminal module 130 and is threaded into the hole 146 to secure the terminal module 130 in place. Thus, the final assembly requires no threading of flexible leads through a loudspeaker cone, requires no delicate soldering, and requires no curing of an adhesive.

A second preferred embodiment of the present invention is shown in FIGS. 14 through 21, in which similar elements are designated by the same numerals used with respect to the first embodiment in FIGS. 1 through 13. Specifically, the second preferred embodiment utilizes an alternative snap ring 172 in place of the snap ring 44 of the first preferred embodiment and utilizes an alternative molded basket 174 adapted to receive the snap ring 172. All other elements of the second preferred embodiment are unchanged from those of the first preferred embodiment previously described. The preferred material for the snap ring 172 and the molded basket 174 is Noryl N300; however, other tough, resilient plastics such as ABS may be used.

Figure 16:
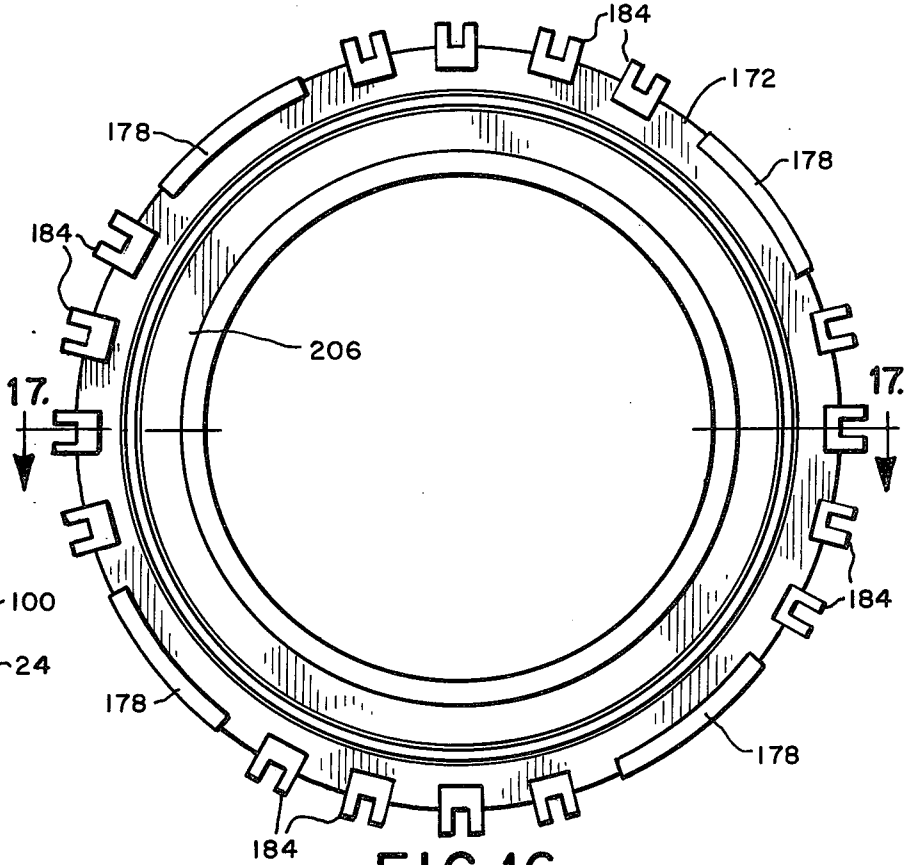
FIG. 16 is a rear elevation of the snap ring of the second preferred embodiment of the present invention.
Figure 17:
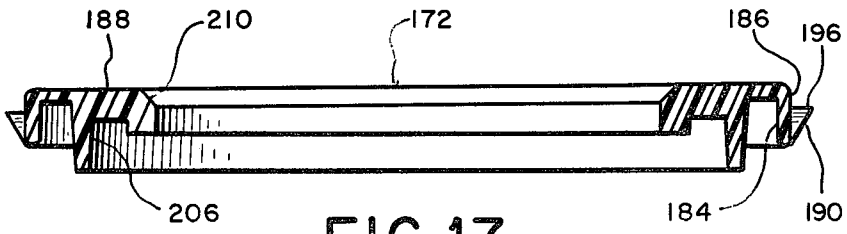
FIG. 17 is a sectional view of the snap ring of the second preferred embodiment of the present invention taken along the line 17—17 of FIG. 16.
Figure 14:
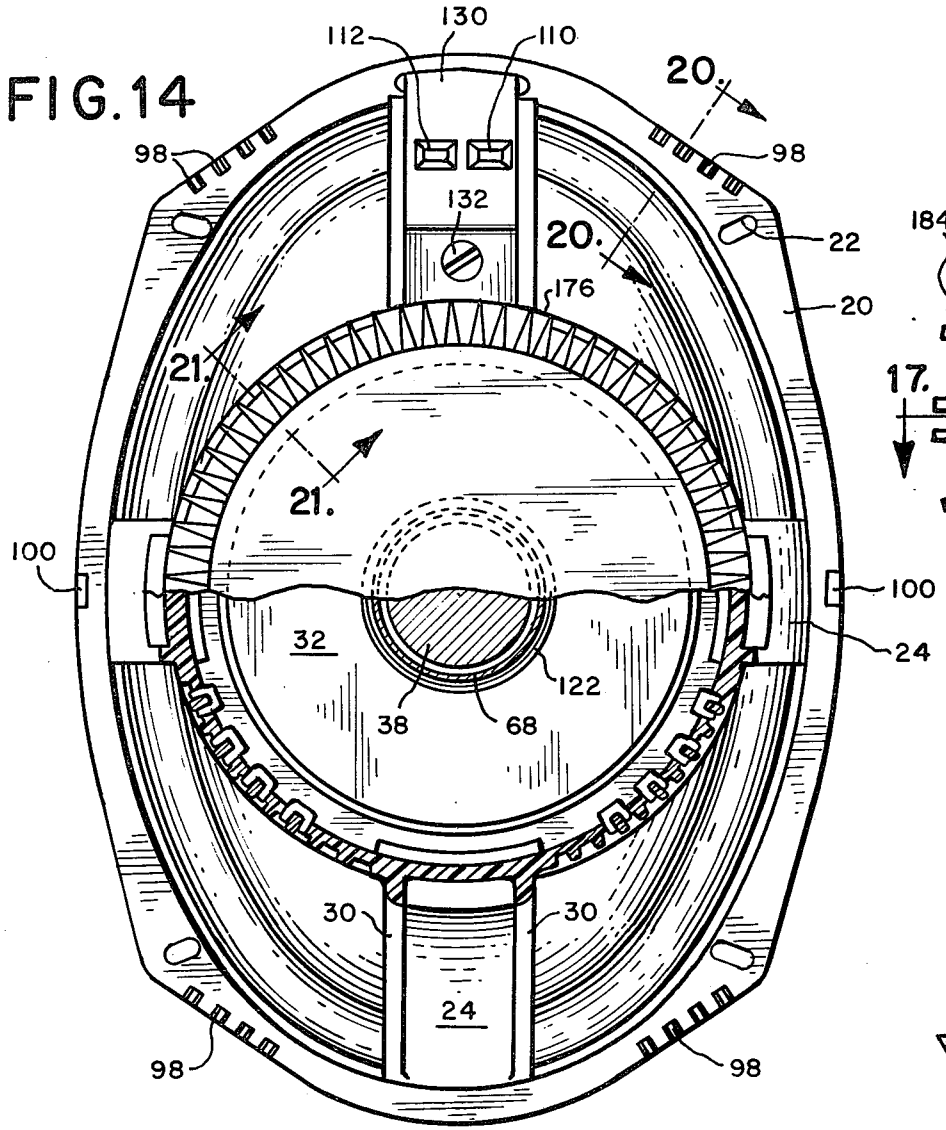
FIG. 14 is a rear view of a second preferred embodiment of the present invention, partially in section as indicated by the line 14—14 of FIG. 15.
Figure 15:
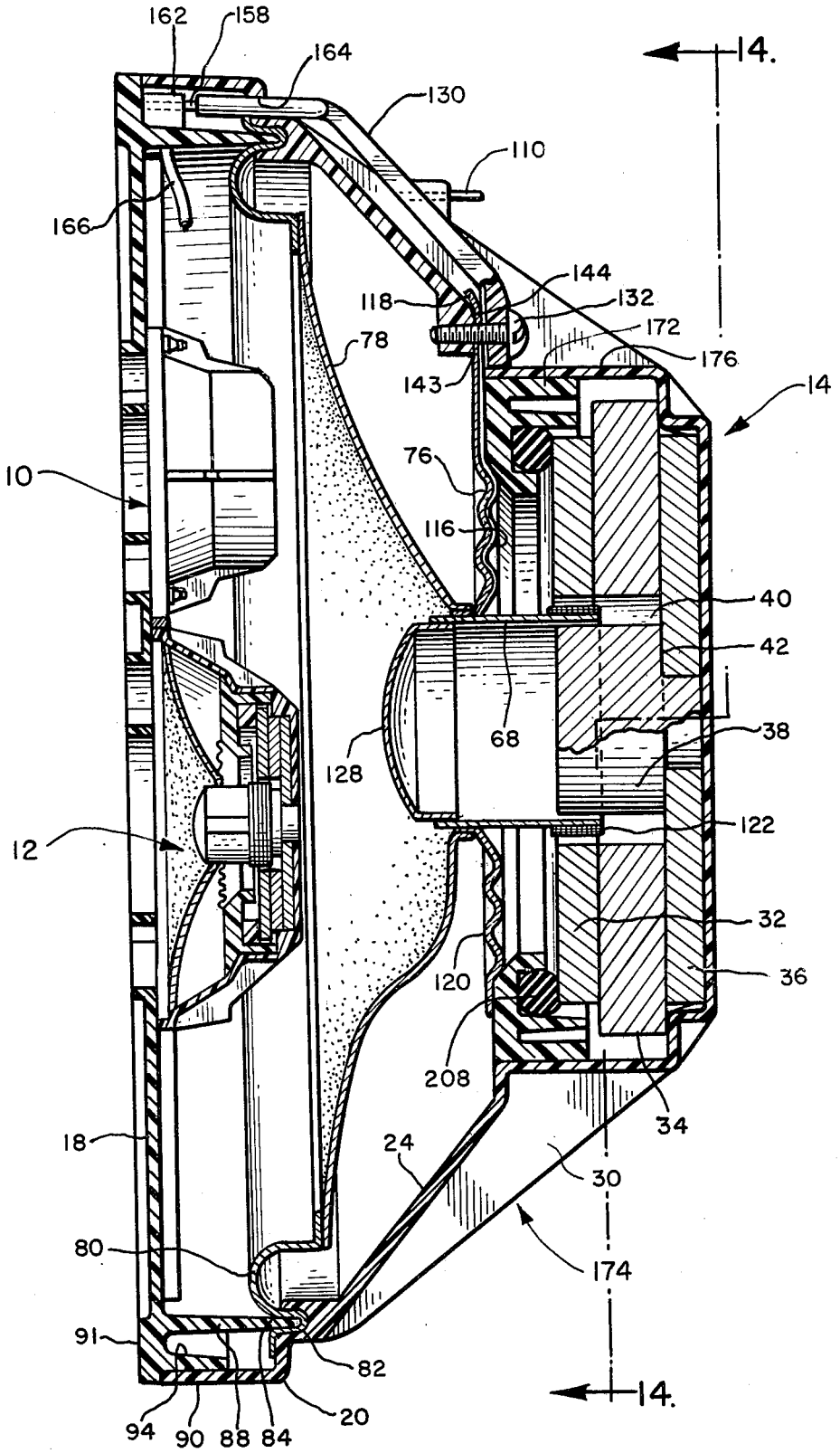
FIG. 15 is a sectional view of the second preferred embodiment of the present invention, as viewed from the right side analogous to FIG. 4.

In the second preferred embodiment, the elements of the magnet are mounted within a cylindrical portion 176 of the molded basket 174 by means of the snap ring 172 as shown in FIGS. 15 and 21. The snap ring 172 includes four equally spaced alignment ribs 178 which protrude radially for engagement of corresponding channels 180 formed between locating flanges 182 of the molded basket 174 as shown in FIGS. 16 and 18, respectively. The snap ring 172 also includes regularly spaced pairs of resilient locking fingers 184 which include stalk portions 186 which extend rearward from a flat annular surface 188, as shown in FIG. 17, to permit flexing of the locking fingers 184. The locking fingers 184 include striking portions 190, as shown in FIG. 18, for directing the locking fingers 184 into a cylindrical cavity 192 of the molded basket 174.

A series of rectangular openings 194 is spaced within the cylindrical cavity 192 so as to correspond to the locking fingers 184. The rectangular openings 194 receive the striking portions 190 when the snap ring 172 is pressed into the molded basket 174 to its assembled position, as shown in FIG. 21. The striking portions 190 of the locking fingers 184 form an interference fit with the cylindrical cavity 192. Due to the resiliency of the locking fingers 182, the locking fingers 182 are deflected radially inward during assembly, causing flexing of the stalk portions 186. Flat barb portions 196 engage the forward ends of the rectangular openings 194 to lock the snap ring in position when the locking fingers snap outward upon reaching their assembled positions.

Unlike the first preferred embodiment, alignment of the elements of the magnet is provided by two annular rows 198 and 200 of deformable fins 202 and 204, respectively, formed within the molded basket 174, as shown in FIGS. 18 and 19. (In contrast, the annular rows 58 and 60 of deformable fins of the first preferred embodiment were upon the snap ring 44 rather than upon the molded basket 16.) The fins 202 and 204 provide an interference fit with the annular ring 32 and the rear pole plate 36, respectively, of the magnet. The snap ring 172 includes no alignment fins but includes an annular channel 206 for receiving a neoprene O-ring 208. The O-ring 208 is concentric with the elements of the magnet and has a diameter such that it contacts both the flat forward surface and the cylindrical side surface of the front pole plate 32 when the magnet is mounted within the molded basket 174, as shown in FIG. 21. As with the first preferred embodiment, the snap ring 172 includes a chamfer 210 to provide clearance for the spider 76.

During assembly of the second preferred embodiment, a fixture is positioned within the annular gap 40 before the elements of the magnet and the snap ring are mounted within the molded basket 174. As the snap ring 172 is pressed into its assembled position shown in FIGS. 15 and 21, the O-ring 208 forces the annular ring 34 and rear pole plate 36 to their seated positions against an internal shoulder 210 and a rear wall surface 212, respectively. The fins 202 and 204 assist in centering the elements of the magnet and are crushed around the cylindrical side surfaces of the annular ring 34 and rear pole plate 36, respectively, during assembly. The crushed fins 202 and 204 thus form a pocket around the elements of the magnet to prevent shifting of the annular ring 34 and rear pole plate 36 after removal of the fixture from the annular gap 40. The crushing of the fins 202 and 204 ensures that a tightly fitting pocket will be formed about the annular ring 34 and rear pole plate 36 regardless of manufacturing defects in the diameters thereof. Note that the assembled position of the snap ring 172 leaves a small space between a flat annular surface 214 of the snap ring 172 and the front pole plate 32. Unlike the first preferred embodiment, the axial location of the magnet relative to the spider 76 is fixed by the seating of the annular ring 34 and the rear pole plate 36 against the annular shoulder 210 and rear wall surface 212, respectively.

The loudspeaker construction and method of assembly of the present invention is not limited to one particular size of loudspeaker. As shown in FIG. 4, the midrange 12 of the 3-way loudspeaker system may have a construction similar to the woofer 14 of the second preferred embodiment. The midrange 12 includes a molded basket 216 which includes reinforcing ribs 218 and mounting ears with mounting holes for engagement of the fixing studs 152. A snap ring 220 locks the elements of the magnet 222 in position against the rear of the molded basket 216. Deformable fins are formed in the molded basket 216 in an interference relationship to the elements of the magnet 222 so as to be crushed during assembly. A resilient tension ring 224 may have a rectangular cross section instead of the round cross section of the O-ring 208 used in the woofer 14. A cone 226, a voice coil 228, and a spider 230 of the midrange 12 may be similar to those of the woofer 14 or may be of a more conventional construction.

An important feature of the present invention, as illustrated by either of the preferred embodiments, is that leakage of the magnetic flux from the annular gap is virtually eliminated due to the extensive use of plastic. This results in increased flux and more uniform flux within the annular gap for superior acoustical performance of the loudspeaker. This extensive use of plastic also results in reduction or even elimination of "ringing" common in many loudspeakers having metal components.

A second feature of the present invention is the enclosing of the magnet by the molded basket, the snap ring, and the spider. In this way, the elements of the magnet are protected from chipping or other damage. Further, the relatively unsightly elements of the magnet are hidden from view, and superficial manufacturing defects in the elements of the magnet are no longer a problem.

Another feature of the present invention is that an improved flexible electrical connection between the voice coil and the terminals supported from the speaker basket is provided. The conductive strips upon the spider eliminate the soldered braided leads which are a major source of loudspeaker failure and which may cause spurious sounds.

Another feature of the present invention is the elimination of labor intensive operations. By replacing the soldered braided leads with the conductive strips, by combining several components of conventional loudspeakers into single integrated units, and by simplifying assembly steps, the quality of the loudspeaker is more uniformly maintained and costs of manufacture are reduced. Applicant has determined that the 3-way loudspeaker systems of the preferred embodiments have only 21 elements in contrast to the 42 elements of a similar 3-way loudspeaker system of conventional construction.

Another feature of the present invention is the substantial elimination of adhesives in the final assembly of a loudspeaker system. The fixing of the elements of the magnet and the fixing of the foam surround of the cone by snap-together plastic components simplifies assembly and eliminates the need for a time consuming curing of adhesive, thereby reducing manufacturing costs.

From the foregoing, it should be apparent that an improved loudspeaker construction and a method of assembly therefor have been disclosed. This construction offers the advantages of extensive use of plastic, reduction in the number of components, and a more pleasing and variable appearance. The acoustical performance of the loudspeaker is enhanced and a major source of loudspeaker failure is eliminated. Additionally, assembly is greatly simplified and cost of manufacture is significantly reduced.

Individual features disclosed herein may be utilized alone or in various combinations in loudspeakers using conventional components. For example, a multiple loudspeaker system may include the bridge subassembly of the present invention in combination with a conventional loudspeaker basket and a conventional method of fixing the elements of the magnet. Similarly, the method of the present invention of fixing the elements of the magnet may be included in a loudspeaker having conventional lead wires in place of the conductive strips. Further, the capturing of the surround of the loudspeaker cone by a lock member or, alternatively, the including of conductive strips within the centering disc may be used in otherwise conventional loudspeakers. Other unlisted combinations would also realize one or more advantages of the features of the present invention.

Of course, it should be understood that various changes and modifications to the preferred embodiments described above will be apparent to those skilled in the art. For example, the snap ring and face plate may include detent means other than the locking fingers of the preferred embodiments such as bayonet or screw type threads or locking fingers formed on the basket rather than upon the snap ring and face plate. Further, the locking fingers may engage shallow recesses rather than the openings of the preferred embodiments. The term mechanical interlock means as used in the claims is defined to include, but is not to be limited to, each of these variations. Additionally, various embodiments of the present invention may be adapted for specific sizes and shapes of loudspeakers or multiple loudspeaker systems. It is therefore intended that the foregoing detailed description be regarded as illustrative rather than limiting and that it be understood that it is the following claims, including all equivalents, that are intended to define the scope of this invention.

I claim:

1. In an improved loudspeaker assembly of the type having a magnet supported by a basket, a voice coil movable axially within an annular gap of the magnet, and a diaphragm fixed to the voice coil for movement with the voice coil, the improvement comprising:

means for defining a recess within the basket for receiving the magnet so as to enclose a portion of the magnet; and a lock member in mechanical engagement with the basket so as to further enclose the magnet and lock the magnet in position by pressure against the magnet, one of said basket and lock member defining at least one resilient locking projection and the other of said basket and lock member defining a mating locking surface, said locking projection positioned and configured automatically to bend away from the mating locking surface during assembly of the basket and lock member and automatically to spring back into mechanical engagement with the mating locking surface when the basket and lock members are assembled.

2. The improvement in a loudspeaker assembly as recited in claim 1 wherein the basket comprises a plastic basket member.

3. The improvement in a loudspeaker assembly as recited in claim 1 wherein the magnet comprises a front pole portion, a rear pole portion, and a body portion between the front and rear pole portions locked together by the lock member against relative movement so as to maintain the front pole, rear pole and body portions in alignment.

4. The improvement in a loudspeaker assembly as recited in claim 1 wherein at least one locking projection comprises a plurality of spaced apart projections, wherein the at least one locking surface comprises a plurality of locking surfaces, wherein each of said locking projections includes a beveled striking surface for facilitating assembly and barb means for engaging a mating one of the locking surfaces for providing positive front to rear positioning of the lock member relative to the basket.

5. The improvement in a loudspeaker assembly as recited in claim 1 which further comprises biasing means adjacent the magnet and between the lock member and the basket for applying constant pressure against the magnet to hold the magnet in position.

6. The improvement in a loudspeaker assembly as recited in claim 5 wherein the biasing means comprises a resilient ring compressed between the magnet and the lock member.

7. The improvement in a loudspeaker assembly as recited in claim 1 wherein the basket is made of plastic and includes a forwardly facing recess for receiving the magnet so as to substantially enclose the rearward portion of the magnet, and wherein the lock member is made of plastic and is mechanically engageable with the basket so as to substantially enclose the forward perimeter of the magnet and lock the magnet in position by pressure against the perimeter of the magnet.

8. In an improved loudspeaker assembly of the type having a magnet supported by a basket, a voice coil movable axially within an annular gap formed between elements of the magnet, and a diaphragm fixed to the voice coil for movement with the voice coil, the improvement comprising:

a lock member in mechanical engagement with the basket so as to partially enclose the magnet and lock the magnet in position by pressure against the magnet; and plurality of fins mounted on the lock member and deformed about the perimeter of at least one of the elements of the magnet so as to form a tightly fitting structure around the magnet for substantially preventing relative movement between the elements of the magnet so as to maintain the annular gap between the elements of the magnet.

9. In an improved loudspeaker assembly of the type having a magnet supported by a basket, a voice coil movable axially within an annular gap formed between elements of the magnet, and a diaphragm fixed to the voice coil for movement with the voice coil, the improvement comprising:

a plurality of fins mounted on the basket and deformed about the perimeter of at least one of the elements of the magnet so as to form a tightly fitting structure around the magnet for substantially preventing relative movement between the elements of the magnet so as to maintain the annular gap between the elements of the magnet.

10. In an improved loudspeaker assembly of the type having a magnet supported by a basket, a voice coil movable axially within an annular gap of the magnet, a diaphragm fixed to the voice coil for movement with the voice coil, and a centering disc for supporting the voice coil for movement within the annular gap, the improvement comprising:

at least two flexible conductive strips upon the centering disc each conductive strip comprising a multiplicity of overlapping metallic particles, said metallic particles aligned in the plane of the centering disc and overlapping to form a continuous electrical conductor on one surface of the centering disc, the conductive strips extending outward from the voice coil toward the perimeter of the centering disc.

11. The improvement in a loudspeaker assembly as recited in claim 10 further comprising solder joints between the conductive strips and the voice coil so as to form electrical connections between the voice coil and the perimeter of the centering disc.

12. The improvement in a loudspeaker assembly as recited in claim 10 wherein the multiplicity of metallic particles are thermally formed in place on the centering disc in order to place the overlapping particles intimately in contact with each other and with the centering disc.

13. In an improved loudspeaker assembly of the type having a magnet supported by a basket, a voice coil movable axially within an annular gap of the magnet, and a disphragm fixed to the voice coil for movement with the voice coil, the improvement comprising:

a first lock member in mechanical engagement with the basket such that the magnet is positioned between the first lock member and the basket to lock the magnet in place and to enclose at least a portion of the magnet; and a second lock member in mechanical engagement with the basket such that the diaphragm is positioned between the second lock member and the basket so as to mechanically hold the perimeter of the diaphragm and fix the diaphragm to the basket.

14. In an improved loudspeaker assembly of the type having a magnet supported by a basket, a voice coil movable axially within an annular gap of the magnet, and a diaphragm fixed to the voice coil for movement with the voice coil, the improvement comprising:

a lock member having mechanical interlock means in engagement with the basket such that the perimeter of the diaphragm is between the lock member and the basket; and means for defining a tongue on one of the basket and the lock member and a complementary groove upon the other of the basket and the lock member, said tongue and groove positioned so as to abut and press against opposite sides of the diaphragm for frictionally holding the perimeter of the diaphragm in fixed relationship to the basket.

15. The improvement in a loudspeaker assembly as recited in claim 14 wherein the mechanical interlock means of the lock member includes means for providing resilient locking fingers which are biased into engagement with complementary recesses so as to provide a mechanical interlock between the lock member and the basket.

16. The improvement in a loudspeaker assembly as recited in claim 14 wherein the diaphragm comprises a cone with a flexible surround made of synthetic foam, the flexible surround being pinched between the lock member and the basket.

17. In a multiple loudspeaker system of the type having at least one smaller loudspeaker mounted within the basket of a larger loudspeaker which comprises a chassis the improvement comprising:

a bridge member supporting the smaller loudspeaker within the basket of the larger loudspeaker;

detent means on the bridge member for engagement with the basket of the larger loudspeaker to permit snap-together final assembly;

mounting means on the bridge member for mounting the smaller loudspeaker; and terminal means on the bridge member electrically connected to the smaller loudspeaker such that the terminal means is accessible after final assembly of the bridge member to the chassis of the larger loudspeaker.

18. The improvement in a multiple loudspeaker system as recited in claim 17 further comprising means forming a tongue on the bridge member and means forming a cooperating groove on the basket of the larger loudspeaker such that the tongue is engageable with the groove so as to mechanically hold a perimeter portion of a diaphragm of the larger loudspeaker for securing the perimeter portion of the diaphragm to the basket of the larger loudspeaker.

19. The improvement in a multiple loudspeaker system as recited in claim 17 wherein the bridge member is formed of plastic, wherein the detent means comprises a plurality of resilient projections engageable with openings of the basket of the larger loudspeaker, and wherein the mounting means is a plurality of studs engageable with the smaller loudspeaker so as to lock the smaller loudspeaker to the bridge member by friction.

20. In an improved multiple loudspeaker system of the type having at least one smaller loudspeaker mounted within the basket of a larger loudspeaker, the larger loudspeaker having a magnet supported by the basket, a voice coil movable axially within an annular gap of the magnet, a diaphragm fixed to the voice coil for movement with the voice coil, and a centering disc for supporting the voice coil for movement within the annular gap, the improvement comprising:

a plastic basket having a recess for receiving the magnet of the larger loudspeaker;

a plastic first lock member in mechanical engagement with the basket so as to substantially enclose the magnet between the basket and the first lock member and lock the magnet in position by pressure against the magnet;

a resilient ring adjacent the magnet and between the first lock member and the basket compressed against the magnet by the first lock member to aid in holding the magnet in position;

means for providing a plurality of fins between the lock member and the basket deformed about a portion of the perimeter of the magnet to prevent movement of the magnet and to maintain the annular gap;

at least two flexible conductive strips upon the centering disc extending outward from the voice coil toward the perimeter of the centering disc;

a solder joint between each of the conductive strips and the voice coil so as to form electrical connections between the voice coil and the perimeter of the centering disc;

a second lock member in mechanical engagement with the basket so as to mechanically hold the perimeter of the diaphragm and fix the diaphragm to the basket;

means for providing a tongue and a complementary groove between the basket and the second lock member, abutting and pressing against opposite sides of the diaphragm so as to frictionally hold the perimeter of the diaphragm in fixed relationship to the basket;

a bridge member supporting the smaller loudspeaker within the basket;

mounting means on the bridge member for mounting the smaller loudspeaker;

terminal means on the bridge member electrically connected to the smaller loudspeaker such that the terminal means is accessible after final assembly of the bridge member to the basket; and a terminal module mountable upon the basket at final assembly so as to electrically connect the terminal means to the conductive strip.

* * * * *

UNITED STATES PATENT AND TRADEMARK OFFICE

CERTIFICATE OF CORRECTION

PATENT NO. : 4,465,905

DATED : August 14, 1984

INVENTOR(S) : Melvin S. Nation

It is certified that error appears in the above-identified patent and that said Letters Patent is hereby corrected as shown below:

Column 15, line 17, after "wherein" insert -- the --.

Column 15, line 54, before "plurality" insert -- a --.

Column 16, line 36, "disphragm" should read -- diaphragm --.

Signed and Sealed this

Twenty-second Day of December, 1987

*Attest:*

DONALD J. QUIGG

*Attesting Officer*

*Commissioner of Patents and Trademarks*